US009848483B2

(12) United States Patent
Setzer et al.

(10) Patent No.: US 9,848,483 B2
(45) Date of Patent: Dec. 19, 2017

(54) X-RAY TUBE ASSEMBLY

(71) Applicants: Stefan Setzer, Fürth (DE); Stephan Sons, Bubenreuth (DE)

(72) Inventors: Stefan Setzer, Fürth (DE); Stephan Sons, Bubenreuth (DE)

(73) Assignee: Siemens Aktiengesellschaft, München (DE)

( * ) Notice: Subject to any disclaimer, the term of this patent is extended or adjusted under 35 U.S.C. 154(b) by 302 days.

(21) Appl. No.: 14/565,629

(22) Filed: Dec. 10, 2014

(65) Prior Publication Data

US 2015/0163890 A1 Jun. 11, 2015

(30) Foreign Application Priority Data

Dec. 11, 2013 (DE) ..... 10 2013 225 589

(51) Int. Cl.
*H05G 1/34* (2006.01)
*H01J 35/06* (2006.01)

(52) U.S. Cl.
CPC ..... *H05G 1/34* (2013.01); *H01J 35/06* (2013.01)

(58) Field of Classification Search
CPC .. H05G 1/10; H05G 1/12; H05G 1/06; H05G 2/00; H05G 1/32; H05G 1/20; H05G 1/08; H05G 1/34; H05G 1/58; H05G 2/008; H05G 1/265; H05G 2/003; H05G 1/00; H05G 1/085; H05G 1/24; H05G 1/46
See application file for complete search history.

(56) References Cited

U.S. PATENT DOCUMENTS

| | | | | |
|---|---|---|---|---|
| 3,325,645 | A * | 6/1967 | Splain | G05F 1/153 361/187 |
| 4,868,842 | A | 9/1989 | Dowd | |
| 6,118,379 | A | 9/2000 | Kodukula et al. | |
| 2002/0009179 | A1 | 1/2002 | Hess et al. | |
| 2009/0220051 | A1 | 9/2009 | Kutschera | |

FOREIGN PATENT DOCUMENTS

| | | | |
|---|---|---|---|
| CN | 101742796 | A | 6/2010 |
| CN | 102376514 | A | 3/2012 |
| DE | 19842945 | C1 | 3/2000 |
| DE | 19914739 | C1 | 8/2000 |
| DE | 19955845 | A1 | 5/2001 |
| DE | 102008011841 | A1 | 10/2009 |

OTHER PUBLICATIONS

German Office Action in corresponding German Patent Application No. DE 10 2013 225 589.6, dated Nov. 5, 2014, with English translation.

* cited by examiner

*Primary Examiner* — Hoon Song
(74) *Attorney, Agent, or Firm* — Lempia Summerfield Katz LLC

(57) ABSTRACT

An x-ray tube assembly includes an x-ray tube with a vacuum envelope in which an emitter and an anode are arranged. The emitter is configured to be heated by an external coil emitter heating current supply. The emitter is configured as a flat emitter and an adaptation circuit is arranged between the flat emitter and the coil emitter heating current supply. A coil-emitter-based x-ray tube assembly may be replaced by a flat emitter-based x-ray tube assembly without constructional changes.

6 Claims, 3 Drawing Sheets

X-RAY TUBE ASSEMBLY

This application claims the benefit of DE 102013225589.6, filed on Dec. 11, 2013, which is hereby incorporated by reference in its entirety.

FIELD

The invention relates to an x-ray tube assembly.

BACKGROUND

An exemplary cathode with a coil emitter (filament) is described in DE 199 55 845 A1.

Exemplary cathodes having flat emitters are described in DE 199 14 739 C1 and in DE 10 2008 011 841 A1.

Compared to a coil emitter, a flat emitter has a longer service life and also better properties of beam focusing at higher emission densities and lower tube voltages. However, at comparable heat power levels, a flat emitter has a heating current between one and three-times higher with simultaneously lower heating voltage relative to a coil emitter. Flat emitters are therefore preferred in many applications.

In x-ray tube assembly systems, the heating power is provided by a heating current injected into the emitter. For example, switching converters are used for this purpose which, depending on the design of the switching converters, may deliver a predetermined maximum heating current. A simple replacement of a coil-emitter-based x-ray tube assembly (x-ray tube assembly includes an x-ray tube with a coil emitter) by a flat-emitter-based x-ray tube assembly (x-ray tube assembly includes an x-ray tube with a flat emitter) is therefore not readily possible. Modifying the coil emitter heating current supply for use in a flat-emitter-based x-ray tube assembly involves a significant outlay on the system side and leads to increased complexity, because backwards-compatibility is no longer absolutely guaranteed. X-ray tube assembly systems are therefore designed exclusively for coil-emitter based x-ray tube assemblies or exclusively for flat-emitter-based x-ray tube assemblies.

SUMMARY AND DESCRIPTION

The scope of the present invention is defined solely by the appended claims and is not affected to any degree by the statements within this summary.

The present embodiments may obviate one or more of the drawbacks or limitations in the related art. For example, the disclosed embodiments may provide a flat-emitter-based x-ray tube assembly which, without constructional changes, may replace a coil-emitter based x-ray tube assembly. The x-ray tube assembly includes an x-ray tube with a vacuum envelope in which an emitter and an anode are arranged. The emitter is configured to be heated by an external coil emitter heating current supply. In one aspect, the emitter is configured as a flat emitter and an adaptation circuit is arranged between the flat emitter and the coil emitter heating current supply.

In one aspect, arranging an adaptation circuit between the flat emitter and the coil emitter heating current supply enables the limitation of the heating current in the coil emitter heating current supply to be overcome.

The adaptation circuit may be integrated for example into the x-ray tube assembly or may be designed as an external module. The external module may be arranged between the flat emitter and the coil emitter heating current supply. Because the heating power levels in flat emitters and for coil emitters lie in the same order of magnitude, an impedance transformation at this point is sufficient.

The use of the adaptation circuit allows coil-emitter-based x-ray tube assemblies to be replaced by flat-emitter-based x-ray tube assemblies without modification at the x-ray tube assembly system (drop-in replacement). This allows the advantages of flat emitter technology to also be realized for x-ray tube assembly systems with coil-emitter-based x-ray tube assemblies.

Depending on the structure of the coil emitter heating current supply, the adaptation circuit, which is a part of the x-ray tube assembly, may vary.

In one embodiment, the adaptation circuit is configured as a passive impedance transformer.

In one embodiment, the adaptation circuit is configured as an active impedance transformer.

In one embodiment, the coil emitter heating current supply provides an alternating current and the adaptation circuit includes at least one transformer. The transformer is connected on the primary side to the coil emitter heating current supply and on the secondary side to the flat emitter. Through this arrangement, as a transformer, the passive impedance transformer has a constructively simple structure.

In one embodiment, the coil emitter heating current supply provides an alternating current and the adaptation circuit includes a rectifier arrangement, a downstream low-pass filter and an impedance transformation unit with at least one DC-DC converter. The rectifier arrangement is connected to the coil emitter heating current supply and the impedance transformation unit is connected to the flat emitter.

In one embodiment, the coil emitter heating current supply provides a rectified alternating current and the adaptation circuit includes a low-pass filter and an impedance transformation unit with at least one DC-DC converter. The low-pass filter is connected to the coil emitter heating current supply and the impedance transformation unit is connected to the flat emitter.

In one embodiment, the coil emitter heating current supply provides a direct current and the adaptation circuit includes an impedance transformation unit with at least one DC-DC converter. The DC-DC converter is connected on the input side to the coil emitter heating current supply and on the output side to the flat emitter.

In one embodiment, the coil emitter heating current supply provides an alternating current and the adaptation circuit includes a transformer, a rectifier arrangement and a downstream low-pass filter. The transformer is connected on the primary side to the coil emitter heating current supply and on the secondary side to the rectifier arrangement. The low-pass filter is connected to the flat emitter. A variant of the adaptation circuit is thus involved here, which includes a transformer and a rectifier arrangement with low-pass filter, but not a DC-DC converter.

DETAILED DESCRIPTION

Figure 1:
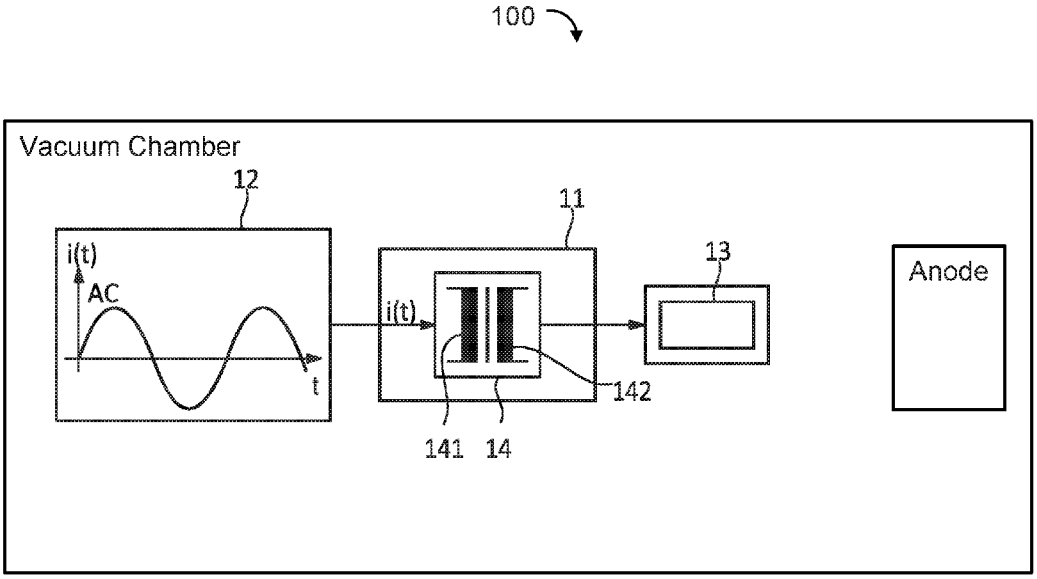
FIG. 1 shows an adaptation circuit in accordance with one embodiment of an x-ray tube assembly.

The exemplary embodiment of an x-ray tube assembly 100 shown in FIG. 1 includes an adaptation circuit 11, which is disposed between an external coil emitter heating current supply 12 and a flat emitter 13.

The coil emitter heating current supply 12 provides an alternating current $i_{AC}(t)$. The adaptation circuit 11 is configured as a passive impedance transformer and, in the exemplary embodiment shown, includes a transformer 14 with a primary winding 141 and a secondary winding 142. The transformer 14 is connected on the primary side to the coil emitter heating current supply 12 and on the secondary side to the flat emitter 13. Through this arrangement, the flat emitter 13 is supplied with alternating current.

Figure 2:
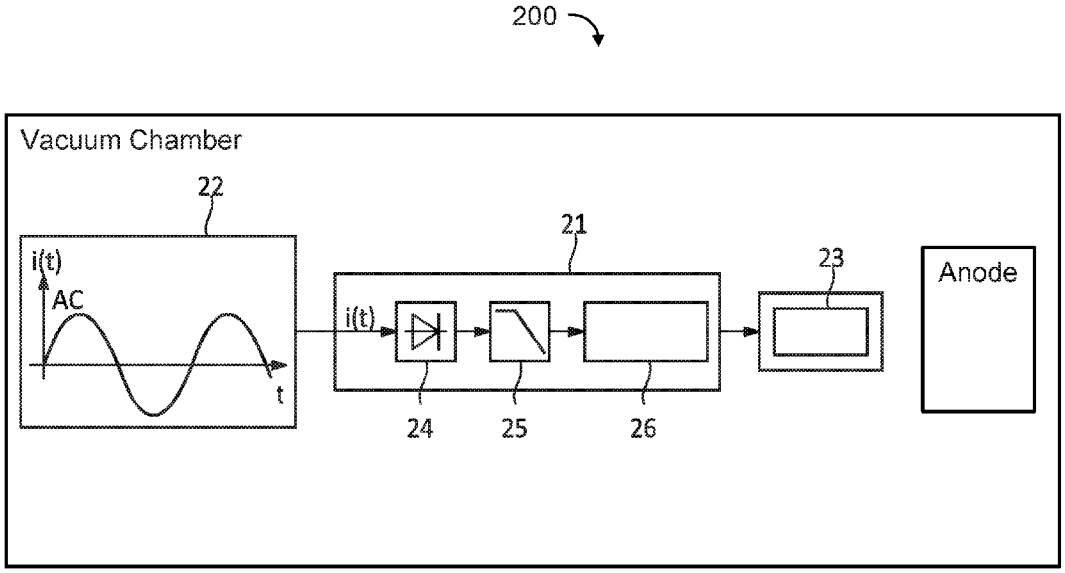
FIG. 2 shows an adaptation circuit in accordance with another embodiment of an x-ray tube assembly.

The embodiment of an x-ray tube assembly 200 shown in FIG. 2 includes an adaptation circuit 21, which is disposed between an external coil emitter heating current supply 22 and a flat emitter 23.

The coil emitter heating current supply 22 provides an alternating current $i_{AC}(t)$. The adaptation circuit 21 is configured as an active impedance transformer and, in the exemplary embodiment shown, includes a rectifier arrangement 24, a downstream low-pass filter 25 and an impedance transformation unit 26 with at least one DC-DC converter. The rectifier arrangement is connected to the coil emitter heating current supply 22 and the impedance transformation unit 26 is connected to the flat emitter 23. Through this arrangement, the flat emitter 23 is supplied with direct current.

Figure 3:
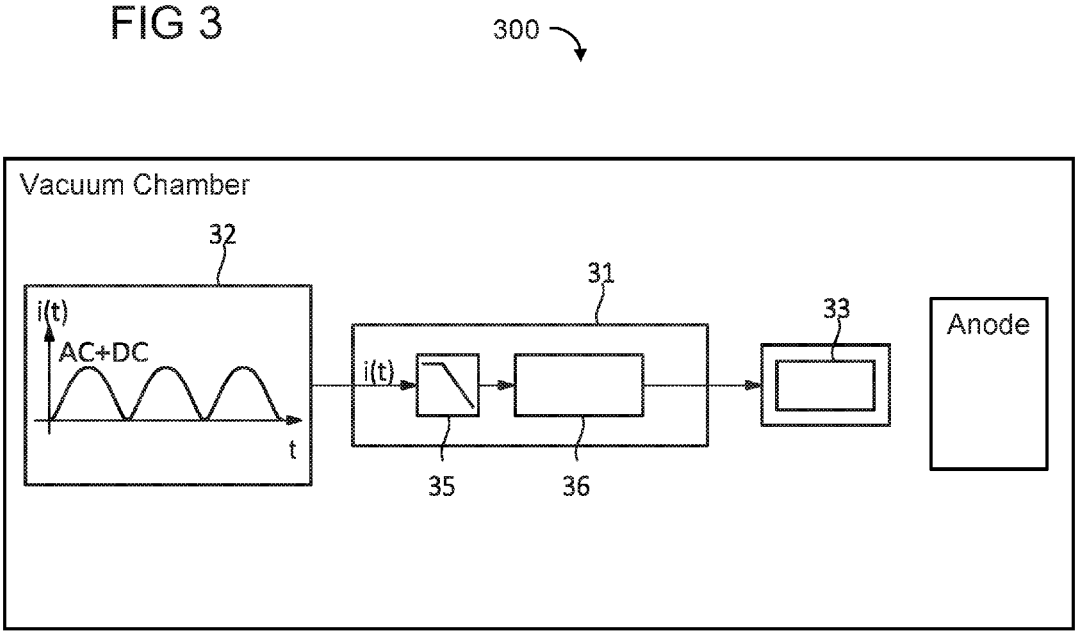
FIG. 3 shows an adaptation circuit in accordance with yet another embodiment of an x-ray tube assembly.

FIG. 3 shows an embodiment of an x-ray tube assembly 300 including an adaptation circuit 31, which is disposed between an external coil emitter heating current supply 32 and a flat emitter 33.

The coil emitter heating current supply 32 provides a rectified alternating current $i_{AC+DC}(t)$. The adaptation circuit 31 is configured as an active impedance transformer and, in the exemplary embodiment shown, includes a low-pass filter 35 and an impedance transformation unit 36 with at least one DC-DC converter. The low-pass filter 35 is connected to the coil emitter heating current supply 32 and the impedance transformation unit 36 is connected to the flat emitter 33. Through this arrangement, the flat emitter 33 is supplied with direct current.

Figure 4:
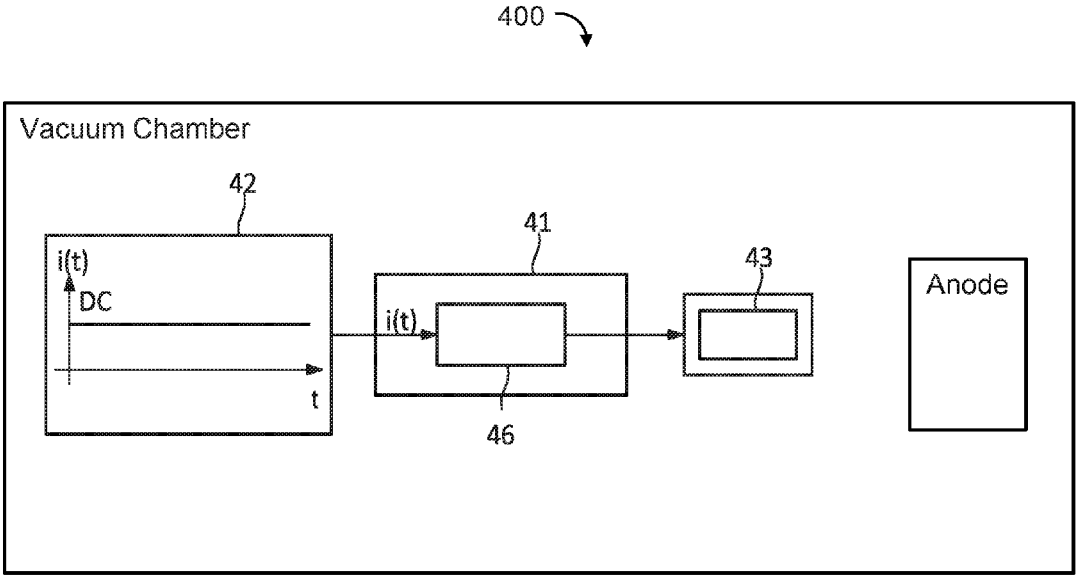
FIG. 4 shows an adaptation circuit in accordance with still another embodiment of an x-ray tube assembly.

The embodiment of an x-ray tube assembly 400 shown in FIG. 4 includes an adaptation circuit 41, which is disposed between an external coil emitter heating current supply 42 and a flat emitter 43.

The coil emitter heating current supply 42 provides a direct current $i_{DC}(t)$. The adaptation circuit 41 is configured as an active impedance transformer and, in the exemplary embodiment shown, includes an impedance transformation unit 46 with at least one DC-DC converter. The impedance transformation unit 46 is connected on the input side to the coil emitter heating current supply 42 and is connected on the output side to the flat emitter 43. Through this arrangement, the flat emitter 43 is supplied with direct current.

Figure 5:
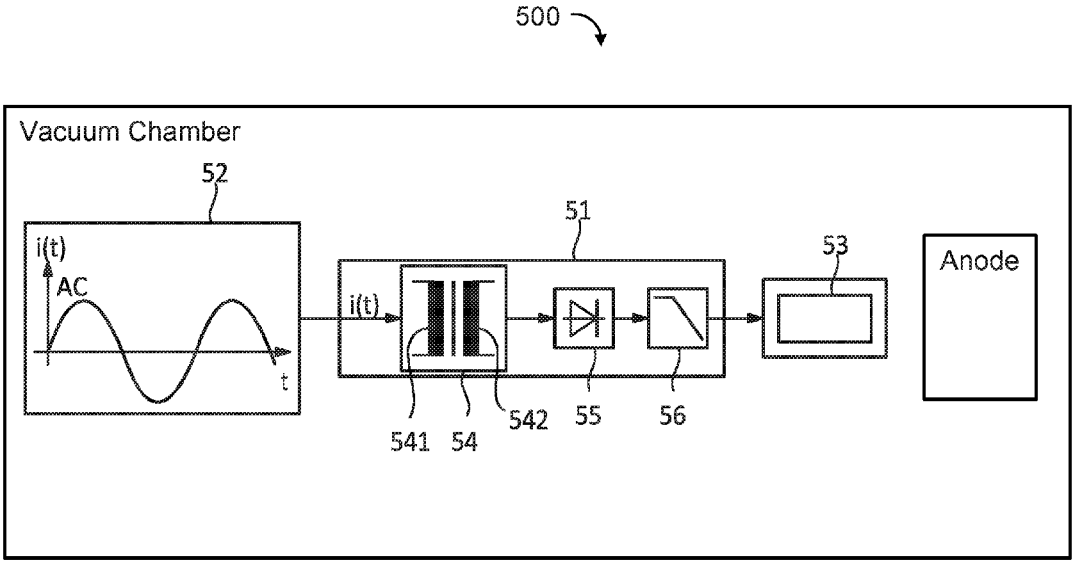
FIG. 5 shows an adaptation circuit in accordance with one embodiment of an x-ray tube assembly.

The exemplary embodiment of an x-ray tube assembly 500 shown in FIG. 5 includes an adaptation circuit 51, which is disposed between an external coil emitter heating current supply 52 and a flat emitter 53.

The coil emitter heating current supply 52 provides an alternating current $i_{AC}(t)$. The adaptation circuit 51 is designed as an active impedance transformer and, in the exemplary embodiment shown, includes a transformer 54 with a primary winding 541 and a secondary winding 542. Furthermore, the adaptation circuit 51 includes a rectifier arrangement 55 and a downstream low-pass filter 56. The transformer 54 is connected on the primary side to the coil emitter heating current supply 52 and on the secondary side to the rectifier arrangement 55. The low-pass filter 56 is connected to the flat emitter 53. Through this arrangement, the flat emitter 53 is supplied with direct current.

With the embodiments described in FIGS. 1-5, either alternating current (FIG. 1) or direct current (FIGS. 2-5) is supplied as heating current to the flat emitters. Consequently, a magnetic field is always created in the area of the emission surface of the flat emitter. This magnetic field deflects the electrons and may thereby have a negative effect on the focusing quality that may be achieved.

In the event of alternating current being supplied (FIG. 1), the electrons are deflected in each case during a period to a maximum in a positive and negative direction. Whereas, when direct current is supplied (FIGS. 2-5), only a static deflection of the electrons occurs, which however is easier to manage relative to supplying alternating current and, thus, delivers better focusing qualities.

The exemplary embodiments may be realized for a plurality of x-ray tube assemblies and is thus suitable for a plurality of x-ray tube assembly systems.

The described solution enables a coil-emitter-based x-ray tube assembly to be replaced by a flat emitter-based x-ray tube assembly without constructional changes.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it should be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. An x-ray tube assembly comprising:

an x-ray tube comprising a vacuum envelope;

an emitter arranged in the vacuum envelope, wherein the emitter is configured to be heated by an external coil emitter heating current supply, and wherein the emitter is configured as a flat emitter;

an anode arranged in the vacuum envelope; and an adaptation circuit disposed between the flat emitter and the coil emitter heating current supply, wherein the adaptation circuit is configured as an active impedance transformer, wherein the external coil emitter heating current supply provides a rectified alternating current, and the adaptation circuit includes a low-pass filter and an impedance transformation unit with at least one DC-DC converter, and wherein the low-pass filter is connected to the external coil emitter heating current supply, and the impedance transformation unit is connected to the flat emitter.

2. The x-ray tube assembly of claim 1, wherein the adaptation circuit is configured as a passive impedance transformer.

3. The x-ray tube assembly of claim 2, wherein the coil emitter heating current supply provides an alternating current, and wherein the adaptation circuit includes at least one transformer, the at least one transformer being connected on a primary side to the coil emitter heating current supply and on a secondary side to the flat emitter.

4. The x-ray tube assembly of claim 1, wherein the coil emitter heating current supply provides an alternating current, and wherein the adaptation circuit includes a rectifier arrangement, a downstream low-pass filter and an impedance transformation unit with at least one DC-DC converter, wherein the rectifier arrangement is connected to the coil emitter heating current supply and the impedance transformation unit is connected to the flat emitter.

5. The x-ray tube assembly of claim 1, wherein the coil emitter heating current supply provides an alternating current and the adaptation circuit includes an impedance transformation unit with at least one DC-DC converter, wherein the at least one DC-DC converter is connected on an input side to the coil emitter heating current supply and is connected on an output side to the flat emitter.

6. The x-ray tube assembly of claim 1, wherein the coil emitter heating current supply provides an alternating current and the adaptation circuit includes a transformer, a rectifier arrangement and a downstream low-pass filter, wherein the transformer is connected on a primary side to the coil emitter heating current supply and on a secondary side to the rectifier arrangement and the low-pass filter is connected to the flat emitter.

* * * * *